US010531721B2

(12) United States Patent
Crawford et al.

(10) Patent No.: US 10,531,721 B2
(45) Date of Patent: Jan. 14, 2020

(54) DEODORANT DISPENSER AND REFILL CARTRIDGE THEREFOR

(71) Applicant: COLGATE-PALMOLIVE COMPANY, New York, NY (US)

(72) Inventors: John C. Crawford, Mahopac, NY (US); Bruce Cummings, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/908,814

(22) PCT Filed: Aug. 8, 2013

(86) PCT No.: PCT/US2013/054126

§ 371 (c)(1),
(2) Date: Jan. 29, 2016

(87) PCT Pub. No.: WO2015/020659

PCT Pub. Date: Feb. 12, 2015

(65) Prior Publication Data

US 2016/0157580 A1 Jun. 9, 2016

(51) Int. Cl.

| | |
|---|---|
| ***A45D 34/00*** | (2006.01) |
| ***A45D 34/04*** | (2006.01) |
| ***B65D 53/06*** | (2006.01) |

(52) U.S. Cl.

CPC ..... *A45D 34/041* (2013.01); *B65D 53/06* (2013.01); *A45D 2034/005* (2013.01)

(58) Field of Classification Search

CPC ..... A45D 2034/005

(Continued)

(56) References Cited

U.S. PATENT DOCUMENTS 3,212,120 A * 10/1965 Gentile ..... A45D 34/041 401/175
3,995,772 A * 12/1976 Liautaud ..... B05B 11/048 222/83.5

(Continued)

FOREIGN PATENT DOCUMENTS

| | | |
|---|---|---|
| CA | 2075473 | 8/1991 |
| DE | 9010979 | 10/1990 |

(Continued)

OTHER PUBLICATIONS

International Search Report and the Written Opinion of the International Searching Authority issued in International Application PCT/US2013/054126 dated Apr. 23, 2014.

*Primary Examiner* — David J Walczak
*Assistant Examiner* — Joshua R Wiljanen

(57) ABSTRACT

Disclosed is a deodorant dispenser refill cartridge, comprising: a container defining a chamber storing a fluid deodorant composition and having an opening through which the composition is dispensable from the chamber; and a seal sealing the opening. Also disclosed is a deodorant dispenser, comprising: a body having a cavity for receiving a first portion of the refill cartridge; a device within the cavity and extending along at least a portion of an edge region of the cavity for puncturing the seal of the refill cartridge as the first portion of the refill cartridge is received in the cavity of the body; and an applicator for applying the fluid deodorant composition to a user at an exterior of the dispenser.

22 Claims, 3 Drawing Sheets

(58) Field of Classification Search
USPC ..... 401/132, 133, 134, 135, 209, 216, 220
See application file for complete search history.

(56) References Cited

U.S. PATENT DOCUMENTS

| | | | | |
|---|---|---|---|---|
| 4,884,912 | A | 12/1989 | Gueret | |
| 5,180,242 | A * | 1/1993 | De Laforcade ..... | A45D 34/041 220/276 |
| 5,505,041 | A | 4/1996 | Harlan | |
| 5,526,960 | A | 6/1996 | Breidenbach | |
| 5,586,694 | A | 12/1996 | Breidenbach et al. | |
| 5,938,363 | A | 8/1999 | Timms et al. | |
| 6,095,708 | A * | 8/2000 | Butaud ..... | A45D 34/041 401/209 |
| 6,547,471 | B1 * | 4/2003 | Tucker ..... | B65D 47/2075 401/183 |
| 6,666,216 | B2 | 12/2003 | Bourjal | |
| 6,874,967 | B1 | 4/2005 | Tsaur | |
| 6,929,152 | B2 | 8/2005 | Bonningue | |
| 2002/0025211 | A1 | 2/2002 | Oreal | |
| 2006/0222445 | A1 | 10/2006 | Chuang | |
| 2008/0003052 | A1 * | 1/2008 | Lee ..... | A45D 34/041 401/209 |
| 2012/0155947 | A1 * | 6/2012 | Toh ..... | A45D 34/041 401/209 |

FOREIGN PATENT DOCUMENTS

| | | |
|---|---|---|
| DE | 20009385 | 9/2000 |
| GB | 929331 | 6/1963 |

* cited by examiner

DEODORANT DISPENSER AND REFILL CARTRIDGE THEREFOR

CROSS-REFERENCE TO RELATED PATENT APPLICATIONS

This application is a U.S. national stage application under 35 U.S.C. § 371 of PCT Application No. PCT/US2013/054126, filed Aug. 8, 2013, the entirety of which is incorporated herein by reference.

BACKGROUND

The present invention relates to deodorant dispensers, to a deodorant dispenser refill cartridge, and to a kit comprising a deodorant dispenser refill cartridge and a deodorant dispenser.

It is known to provide a fluid deodorant composition, such as a fluid antiperspirant composition, in a deodorant dispenser that has a movable applicator for applying the composition to a user's body. One such form of dispenser is a roll-on dispenser, in which the applicator is a roller or a ball that is movable relative to a body of the dispenser to carry fluid deodorant composition from within the dispenser to an external surface of the dispenser.

Such dispensers advantageously provide just a thin film of the deodorant composition for applying to the user's body, while preserving the deodorant composition within the dispenser. However, once the deodorant composition in such a dispenser has been used up, the user must dispose of the dispenser and obtain a new one. Such disposal is not an efficient use of the material(s) from which the dispenser is made.

There is a need for a deodorant dispenser that permits more efficient use of the material(s) from which it is made.

BRIEF SUMMARY

An embodiment of the present invention provides a deodorant dispenser refill cartridge, comprising: a container defining a chamber storing a fluid deodorant composition and having an opening through which the composition is dispensable from the chamber; and a seal sealing the opening.

Optionally, the seal is puncturable and/or peelable from the container.

Optionally, the seal comprises one of a film, a membrane, a foil and a closure cap.

Optionally, the seal is adhered or welded to the container.

Optionally, the fluid deodorant composition is a fluid antiperspirant composition.

Optionally, the container has a circular cross section.

Optionally, the seal comprises a closure cap detachably secured to the container. Further optionally, the closure cap is detachably secured to the container by cooperating respective screw threads of the closure cap and the container.

Another embodiment of the present invention provides a kit, comprising: a deodorant dispenser refill cartridge, comprising: a container defining a chamber storing a fluid deodorant composition and having an opening through which the composition is dispensable from the chamber, and a seal sealing the opening; and a deodorant dispenser comprising a body connectable to the refill cartridge, and an applicator for applying the fluid deodorant composition to a user at an exterior of the dispenser.

Optionally, the applicator is movable relative to the body for transporting the fluid deodorant composition to the exterior of the dispenser.

Optionally, the deodorant dispenser comprises a device for puncturing the seal of the refill cartridge as the refill cartridge is connected to the body.

Optionally, the body has a cavity for receiving a first portion of the refill cartridge, wherein the device is within the cavity and extends along at least a portion of an edge region of the cavity, and wherein the device is for puncturing the seal of the refill cartridge as the first portion of the refill cartridge is received into the cavity.

Optionally, the device extends into the opening and along at least a portion of an edge area of the chamber when the refill cartridge is connected to the body.

Optionally, the seal comprises a closure cap detachably secured to the container. Further optionally, the closure cap is detachably secured to the container by cooperating respective screw threads of the closure cap and the container.

Optionally, the applicator is rotatable about a fixed axis relative to the body, or the applicator is freely rotatable relative to the body without constraint to rotation about a fixed axis.

Optionally, the deodorant dispenser comprises a handle detachably securable to the body, wherein at least a portion of the refill cartridge is disposed within the handle when the refill cartridge is connected to the body and the handle is detachably secured to the body.

Optionally, when the refill cartridge is connected to the body, the refill cartridge forms a portion of an exterior surface of the deodorant dispenser.

A further embodiment of the present invention provides a deodorant dispenser, comprising: a body connected to a removable refill cartridge, the refill cartridge comprising a container defining a chamber storing a fluid deodorant composition and having an opening through which the composition is dispensable from the chamber; and an applicator for applying the fluid deodorant composition to a user at an exterior of the dispenser.

Optionally, the applicator is movable relative to the body for transporting the fluid deodorant composition to the exterior of the dispenser.

Optionally, the body has a device that extends into the opening and along at least a portion of an edge area of the chamber of the refill cartridge.

Optionally, the body has a cavity in which a portion of the refill cartridge is received, wherein the device is disposed within the cavity and extends along at least a portion of an edge region of the cavity.

Optionally, the refill cartridge is detachably secured to the body by cooperating respective screw threads of the refill cartridge and the body.

Optionally, the refill cartridge forms a portion of an exterior surface of the deodorant dispenser.

Optionally, the deodorant dispenser comprises a handle detachably secured to the body and forming a portion of an exterior surface of the deodorant dispenser, wherein at least a portion of the refill cartridge is disposed within the handle.

Optionally, the applicator is rotatable about a fixed axis relative to the body, or the applicator is freely rotatable relative to the body without constraint to rotation about a fixed axis.

A further embodiment of the present invention provides a deodorant dispenser, comprising: a body having a cavity for receiving a first portion of a removable refill cartridge, comprising: a container defining a chamber storing a fluid deodorant composition and having an opening through which the composition is dispensable from the chamber, and a seal sealing the opening; a device within the cavity and extending along at least a portion of an edge region of the cavity for puncturing the seal of the refill cartridge as the first portion of the refill cartridge is received in the cavity of the body; and an applicator for applying the fluid deodorant composition to a user at an exterior of the dispenser.

Optionally, the applicator is movable relative to the body for transporting the fluid deodorant composition to the exterior of the dispenser.

Optionally, the device is tapered.

Optionally, the device comprises a blade.

Optionally, the device is a discontinuous device that extends along only a portion of the edge region of the cavity.

Optionally, the device is arc-shaped.

Optionally, the body comprises a securing device for securing the refill cartridge to the body. Further optionally, the securing device comprises a screw thread.

Optionally, the deodorant dispenser comprises a handle detachably securable to the body to form a portion of an exterior surface of the deodorant dispenser, wherein at least a second portion of the refill cartridge is disposed within the handle when the first portion of the refill cartridge is received in the cavity and the handle is detachably secured to the body.

Optionally, the applicator is rotatable about a fixed axis relative to the body, or the applicator is freely rotatable relative to the body without constraint to rotation about a fixed axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
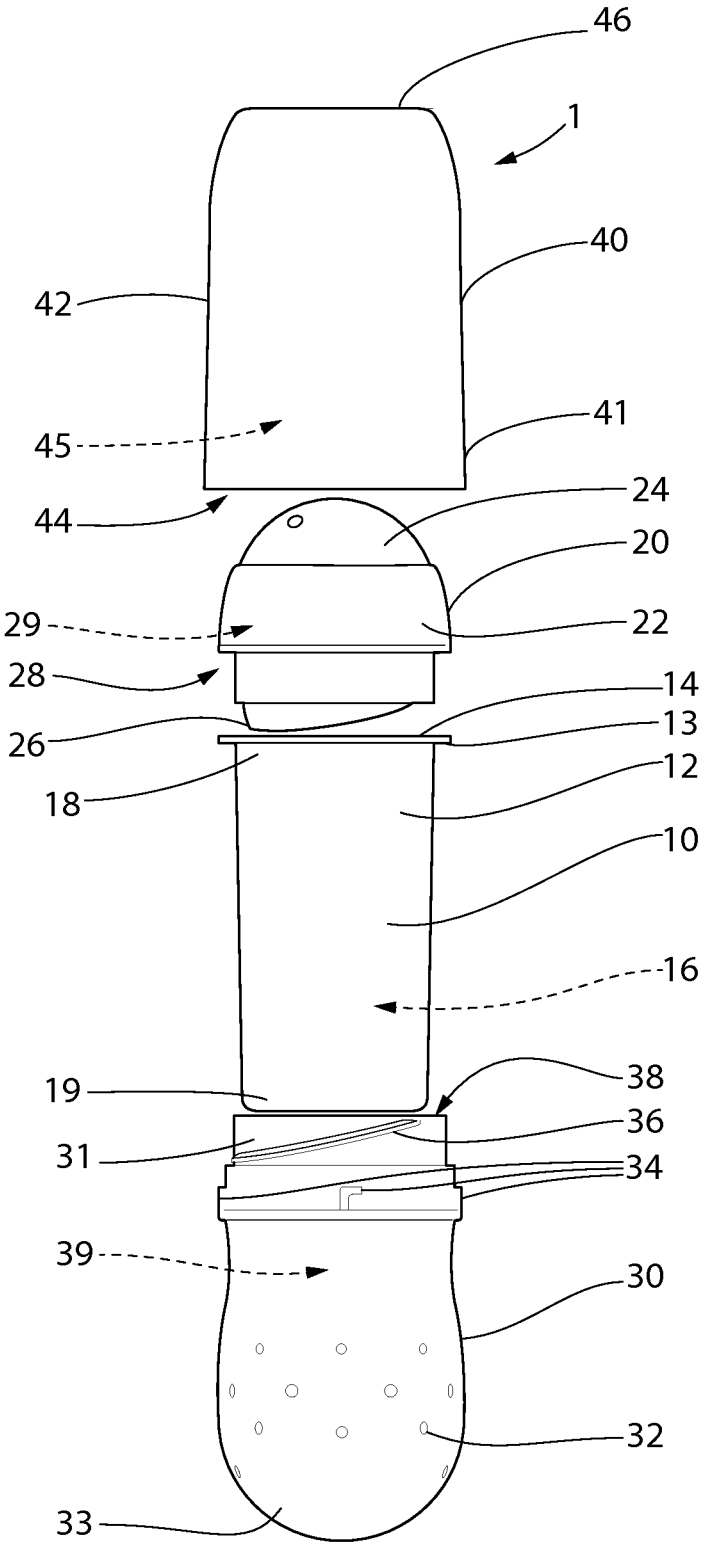
FIG. 1 is an exploded side view of components of a deodorant dispenser according to a first embodiment of the present invention.
Figure 2:
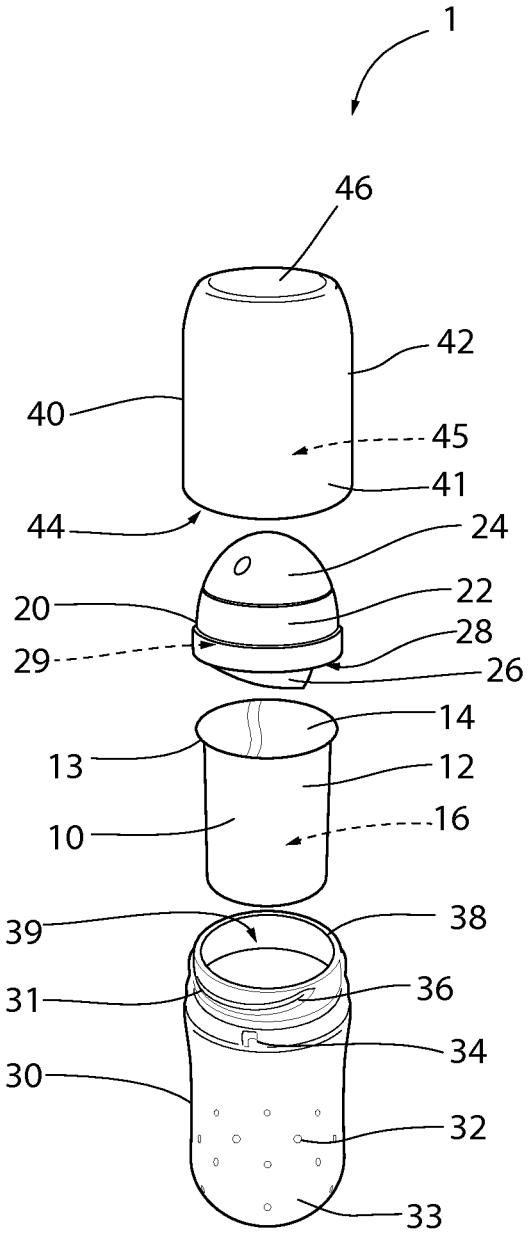
FIG. 2 is an exploded perspective view of the components shown in FIG. 1.

FIGS. 1 and 2 show exploded views of the components of a deodorant dispenser 1 of a first embodiment of the present invention. Briefly, the deodorant dispenser 1 comprises a deodorant dispenser refill cartridge 10, an applicator assembly 20, a handle 30 and a cap 40, each of which will be described in turn.

The refill cartridge 10 comprises a thin-walled container 12 defining a chamber 16 storing a fluid antiperspirant deodorant composition. The container 12 may be flexible or rigid or hard. The container 12 may be less rigid than the handle 30. In a variation to this embodiment, the composition is a fluid deodorant composition that is not an antiperspirant. Herein, by "fluid" it is meant that the deodorant composition is flowable at room temperature and atmospheric pressure. Moreover, herein, by "room temperature" it is meant a temperature of 20 to 25 degrees Celsius, and by "atmospheric pressure" it is meant a pressure of 101 kPa. The container 12 may have been formed by blow injection molding. The container 12 further has a rim defining an opening through which the deodorant composition is dispensable from the chamber 16, and a radially-outwardly extending annular flange 13 surrounding the rim and the opening. The container 12 has a circular cross section that tapers (i.e. reduces in area) slightly over a length of the container 12 from a first end 18 of the container 12 having the rim to the opposite, second (closed) end 19 of the container 12. In a variation to this embodiment, the container 12 instead has a uniform cross section over the majority, or all, of its length.

The refill cartridge 10 further comprises a seal 14 sealing the opening of the container 12. The seal 14 is a puncturable film that is adhered to the rim at the first end 18 of the container 12. In variations to this embodiment, the seal 14 may be one of a membrane and a foil. Moreover, in variations to this embodiment, the seal 14 may be welded to the container 12. Prior to puncturing or removal from the container 12, the seal 14 isolates the chamber 16 and the deodorant composition stored therein from an exterior of the container 12, thereby to preserve the deodorant composition prior to use and to prevent unwanted dispensing or spillage of the deodorant composition.

The applicator assembly 20 comprises a body 22 that is connectable to the refill cartridge 10, and an applicator 24 that is movable relative to the body 22 for transporting the fluid deodorant composition to an exterior of the dispenser 1 when the refill cartridge 10 is connected to the body 22, and for applying the fluid deodorant composition to a user at the exterior of the dispenser 1. In this embodiment, the applicator 24 is a sphere, or ball, that is freely rotatable relative to the body 22 without constraint to rotation about a fixed axis. That is, the sphere is rotatable in any direction about a centre of the sphere relative to the body 22. In a variation to this embodiment, the applicator 24 may instead be a roller, such as a cylinder or a right circular cylinder, that is rotatable about a fixed axis relative to the body 22. That is, the roller has only one degree of freedom and is rotatable only about a central longitudinal axis of the roller relative to the body 22.

The body 22 of the applicator assembly 20 forms a portion of an exterior surface of the dispenser 1, when the dispenser 1 is fully assembled, and defines a cavity 29 for receiving a first portion, comprising the first end 18, of the refill cartridge 10. The cavity 29 has a circular, or substantially circular, cross section. The body 22 also has a rim defining an aperture 28 into the cavity 29, through which aperture 28 the first portion of the refill cartridge 10 is receivable into the cavity 29 when the refill cartridge 10 is connected to the body 22 during assembly of the dispenser 1. The applicator assembly 20 further comprises a device 26 for puncturing the seal 14 of the refill cartridge 10 as the refill cartridge 10 is connected to the body 22. The device 26 is disposed within the cavity 29 of the body 22 with a portion of the device 26 extending through the aperture 28 from within the cavity 29. In this embodiment, the device 26 is tapered and comprises a blade, and it is the blade that extends through the aperture 28 from within the cavity 29. The blade may be integral or unitary with the rest of the body 22.

The device 26 is a discontinuous curved device that extends along only a portion of an edge region of the cavity 29 of the body 22. Accordingly, the device 26 can be considered arc-shaped, as compared to a tube-shaped tapered or sharpened device, which is a continuous curved device. Herein, in this context, "edge region" means an annular region of the cavity 29 that is closer to the material of the body 22 that defines the cavity 29 than to a centre of the cavity 29 in the substantially circular cross section of the cavity 29. Preferably, the edge region extends inwards from the material of the body 22 that defines the cavity 29 and towards the centre of the cavity 29 for no more than 50% of the radius of the cavity 29 in the circular cross section of the cavity 29, and preferably no more than 30% or 20%. Looked at another way, preferably the edge region has a minimum diameter that is no less than 50%, or 70% or 80%, respectively, of the diameter of the cavity 29 in the circular cross section of the cavity 29. Accordingly, preferably, the device 26 is closer to the material of the body 22 that defines the cavity 29 than to the centre of the cavity 29.

When the refill cartridge 10 has been connected to the body 22, the device 26 extends through the seal 14 and the opening of the refill cartridge 10 into the chamber 16 of the refill cartridge 10. The refill cartridge 10 and the device 26 are relatively sized and shaped so that the device 26 extends along only a portion of an edge area of the chamber 16 of the refill cartridge 10, when the refill cartridge 10 has been connected to the body 22. Herein, in this context, "edge are" means an annular area of the chamber 16 that is closer to the material of the container 12 that defines the chamber 16 than to a centre of the chamber 16 in the substantially circular cross section of the container 12. Preferably, the edge area extends inwards from the material of the container 12 that defines the chamber 16 and towards the centre of the chamber 16 for no more than 50% of the radius of the chamber 16 in the substantially circular cross section of the container 12, and preferably no more than 30% or 20%. Looked at another way, preferably the edge area has a minimum diameter that is no less than 50%, or 70% or 80%, respectively, of the diameter of the chamber 16 in the circular cross section of the chamber 16. Accordingly, preferably, the device 26 is closer to the material of the container 12 that defines the chamber 16 than to the centre of the chamber 16 when the refill cartridge 10 has been connected to the body 22.

This relative sizing and shaping of the refill cartridge 10 and the device 26 has the effect that, as the refill cartridge 10 is connected to the body 22, the device 26 creates a slot or hole in the seal 14, which hole is closer to the material of the container 12 that defines the chamber 16 than to the centre of the chamber 16. Accordingly, flow of the fluid deodorant composition, which may be more viscous than water, is facilitated through the opening of the container 12 with little restriction from the material of the seal 14.

The handle 30 comprises a rigid or hard shell 32 defining an interior space 39 of the handle 30. The handle 30 is detachably securable to the body 22 with the shell 32 forming a portion of the exterior surface of the dispenser 1. More specifically, the handle 30 comprises a male screw thread 36 for cooperating with a female screw thread (not shown) of the body 22 to detachably secure the handle 30 to the body 22. The female screw thread is on an interior face of the body 22 that defines the cavity 29. Moreover, the handle 30 is detachably securable to the body 22 with a second portion, comprising the second, closed end 19, of the refill cartridge 10 disposed within the interior space 39 of the handle 30, when the first portion of the refill cartridge 10 is received in the cavity 29 of the body 22 and the refill cartridge 10 is connected to the body 22. The shell 32 also has a rim defining an orifice 38 into the space 39, through which orifice 38 the second portion of the refill cartridge 10 is introducible into the space 39 when the handle 30 is connected to the body 22 with the refill cartridge 10 having already been connected to the body 22. The diameter of the orifice 38, i.e. the internal diameter of the rim of the shell 32, is less than the external diameter of the flange 13 of the refill cartridge 10. The shell 32 of the handle 30 has a first end 31 having the rim and a second (closed) end 33, which in the present embodiment has a rounded or hemispherical convex exterior shape. In a variation to this embodiment, the second end 33 of the shell 32 instead may be flat. An exterior surface of the shell 32 of the handle 30 includes one or more indentations and/or projections for helping a user grip the handle 30 during use of the deodorant dispenser 1. In a variation to this embodiment, the indentations and/or projections may be omitted.

The cap 40 comprises a rigid or hard shell 42 defining an interior space 45 of the cap 40. The cap 40 is detachably securable to the handle 30 with the cap 40 forming a portion of the exterior surface of the dispenser 1. More specifically, the cap 40 comprises a plurality of radially-inwardly extending pins (not shown) for cooperating with a plurality of radially-outwardly extending receptors 34 at the first end 31 of the shell 32 of the handle 30 to detachably secure the cap 40 to the handle 30. The pins are on an interior face of the shell 42 of the cap 40. Moreover, the cap 40 is detachably securable to the handle 30 with the applicator assembly 20 disposed within the interior space 45 of the cap 40, when the first portion of the refill cartridge 10 is received in the cavity 29 of the body 22 and the refill cartridge 10 is connected to the body 22. The shell 42 also has a rim defining an opening 44 into the space 45, through which opening 44 the applicator assembly 20 is introducible into the space 45 when the cap 40 is connected to the handle 30 with the handle 30 having already been connected to the body 22. The shell 42 of the cap 40 has a first end 41 having the rim and a second (closed) end 46, which in the present embodiment is flat. In a variation to this embodiment, the second end 46 of the shell 42 instead may have a rounded or hemispherical convex exterior shape. In a variation to the illustrated embodiment, an exterior surface of the shell 42 of the cap 40 may include one or more indentations and/or projections for helping a user grip the cap 40 during transport of the deodorant dispenser 1.

Assembly of the deodorant dispenser 1 shown in FIGS. 1 to 3 will now be described. First, the second portion of the refill cartridge 10 is inserted through the orifice 38 into the interior space 39 of the handle 30 until the annular flange 13 of the refill cartridge 10 abuts the rim of the shell 32 of the handle 30. Next, the handle 30 is detachably secured to the body 22 of the applicator assembly 20 by rotating the handle 30 relative to the body 22 while mating the male screw thread 36 of the handle 30 with the female screw thread (not shown) of the body 22. During this step, the first portion of the refill cartridge 10 is received through the aperture 28 into the cavity 29 of the body 22 and the device 26 punctures the seal 14 of the refill cartridge 10 to fluidly connect the chamber 16 of the refill cartridge 10 with the applicator 24. In some embodiments, the refill cartridge 10 rotates with the handle 30 relative to the body 22 and the device 26 while the handle 30 is secured to the body 22 and while the device 26 punctures the seal 14. Thereafter, the cap 40 is detachably secured to the handle 30 by rotating the cap 40 relative to the handle 30 while mating the pins of the cap 40 with the receptors 34 of the handle 30. The dispenser 1 is thus fully assembled.

When a user wishes to use the dispenser 1 to apply the fluid deodorant composition to their skin, the user detaches the cap 40 from the handle 30 by rotating the cap 40 relative to the handle 30 to disconnect the pins of the cap 40 from the receptors 34 of the handle 30. While holding the handle 30 at a height greater than the applicator 24, the user presses the applicator 24 to their skin and applies a force to the handle 30 to cause relative movement of the applicator 24 and the body 22. By holding the handle 30 higher than the applicator 24, under the influence of gravity the fluid deodorant composition in the chamber 16 tends towards the applicator 24. The relative movement of the applicator 24 and the body 22 causes the applicator 24 to transport the fluid deodorant composition from the chamber 16 to an exterior of the dispenser 1, i.e. to the portion of the applicator 24 that is exposed at the exterior of the dispenser 1, and thus causes the fluid deodorant composition to be deposited as a thin film on the user's skin.

When most or all of the fluid deodorant composition in the chamber 16 has been dispensed, the refill cartridge 10 can be replaced. To do this, the user detaches the handle 30 from the body 22 by rotating the handle 30 relative to the body 22 to disconnect the male screw thread 36 of the handle 30 from the female screw thread of the body 22. The user then removes the refill cartridge 10 from the space 39 of the handle 30 and disposes of the refill cartridge 10. Preferably the refill cartridge 10 is made of a recyclable material, and the user sends the refill cartridge 10 for recycling. The user then re-assembles the dispenser 1 in the manner discussed above, but using a new, full refill cartridge 10. Accordingly, since the refill cartridge 10 may be disposed of without disposing of the whole dispenser 1 (i.e. without also dispensing of the applicator assembly 20, handle 30 and cap 40), much of the dispenser 1 is re-usable, which is a more efficient use of the materials from which the dispenser 1 is made.

Prior to full assembly of the dispenser 1, the apparatus shown in FIGS. 1 and 2 can be considered a kit comprising (a) the deodorant dispenser refill cartridge 10 and (b) the rest of the components of the dispenser 1. In some cases, the dispenser 1 may be supplied without any deodorant dispenser refill cartridge 10, so that the deodorant dispenser refill cartridge 10 is supplied separately from the rest of the dispenser 1. Indeed, a plurality of deodorant dispenser refill cartridges 10 may be bundled or packaged together for purchase by a user, in order for the user to be able to insert and use each of the plurality of deodorant dispenser refill cartridges 10 in turn in the rest of the dispenser 1.

Figure 3:
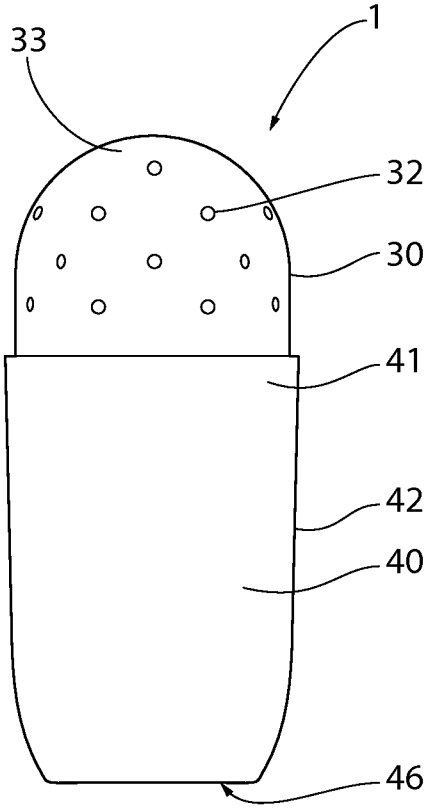
FIG. 3 is a side view of the components shown in FIG. 1 assembled together to form the deodorant dispenser according to the first embodiment of the present invention.

In a variation to the embodiment illustrated in FIGS. 1 to 3, the body 22 may comprise a securing device, such as a screw thread, for mating with a cooperable securing device of the refill cartridge 10 to secure the refill cartridge 10 to the body 22.

In a further variation to the embodiment illustrated in FIGS. 1 to 3, the device 26 may be omitted. In such a variation, the user may puncture or remove the seal 14 of the refill cartridge 10 by hand prior to inserting the cartridge 10 into the space 39 of the handle 30 and/or prior to inserting the cartridge 10 into the cavity 29 of the body 22. The user may puncture the seal 14 using a sharp implement, or may remove the seal 14 by peeling the seal 14 from the container 12. Alternatively, in such a variation, the seal 14 may comprise a closure cap that is detachably secured to the container 12, for example by cooperating respective screw threads of the closure cap and the container 12. The user may remove the closure cap by rotating the closure cap relative to the container 12 to disengage the cooperating respective screw threads of the closure cap and the container 12.

Figure 4:
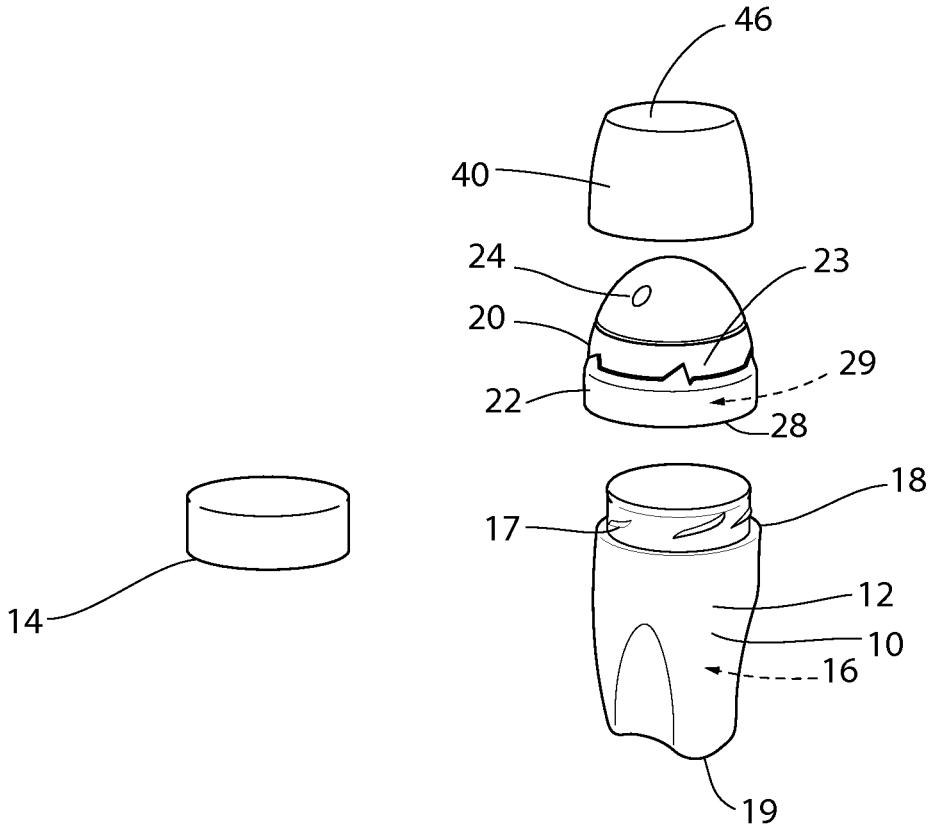
FIG. 4 is an exploded perspective view of components of a deodorant dispenser according to a second embodiment of the present invention.
Figure 5:
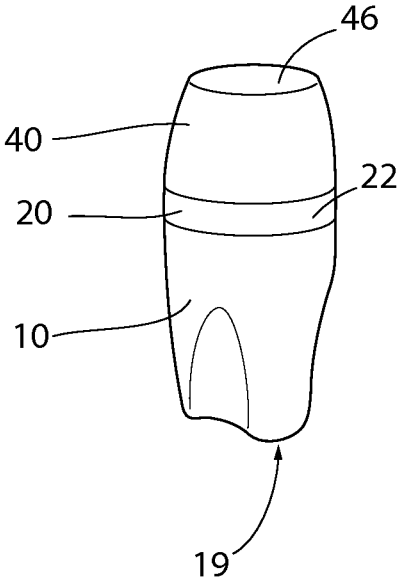
FIG. 5 is a perspective view of the components shown in FIG. 4 assembled together to form the deodorant dispenser according to the second embodiment of the present invention, which dispenser is standing on a flat end of a container thereof.

FIG. 4 shows an exploded perspective view of components of a deodorant dispenser according to a second embodiment of the present invention. The deodorant dispenser 1 of the second embodiment is identical to the deodorant dispenser 1 of the first embodiment, except that the device 26 is omitted and the dispenser 1 has a deodorant dispenser refill cartridge 10 that forms the handle of the dispenser 1. That is, no handle separate from the refill cartridge 10 is provided and the refill cartridge 10 forms a portion of the exterior surface of the deodorant dispenser 1 when the dispenser 1 is fully assembled. Accordingly, preferably the container 12 has sufficient rigidity for a user to hole the dispenser 1 by the container 12 when using the dispenser 1. The second (closed) end 19 of the container 12 is flat, to enable the assembled dispenser 1 to stand upright on the second end 19 of the container 12 when not in use, as shown in FIG. 5. As in the first embodiment, the container 12 of the refill cartridge 10 defines a chamber 16 storing a fluid deodorant composition.

Figure 6:
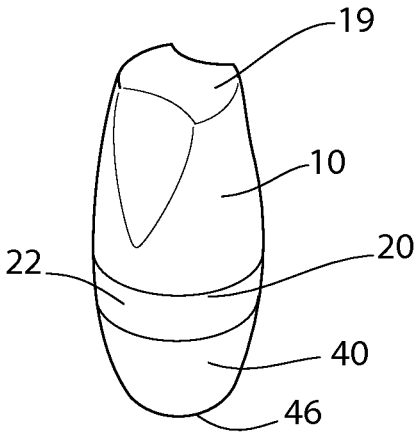
FIG. 6 is another perspective view of the components shown in FIG. 4 assembled together to form the deodorant dispenser according to the second embodiment of the present invention, which dispenser is standing on a flat end of a cap thereof.

In the second embodiment, the body 22 of the applicator assembly 20 comprises a plurality of radially-outwardly extending receptors 23 for cooperating with a plurality of radially-inwardly extending pins (not shown) of the cap 40 to detachably secure the cap 40 to the body 22. The pins are on an interior face of the shell 42 of the cap 40. The cap 40 of the second embodiment is functionally the same as the cap 40 of the first embodiment, except that a distance between the first and second ends 41, 46 is less, relative to an axial height of the applicator assembly 20. The second end 46 of the cap 40 is flat, to enable the assembled dispenser 1 to stand upright on the second end 46 of the cap 40 when not in use, as shown in FIG. 6.

The container 12 of the refill cartridge 10 of the second embodiment comprises a male screw thread 17 for cooperating with a female screw thread (not shown) of the body 22 to detachably secure the refill cartridge 10 to the body 22. As in the first embodiment, the female screw thread is on an interior face of the body 22 that defines the cavity 29. Moreover, the seal 14 of the cartridge 10 comprise a closure cap 14 rather than a film, foil or membrane. The male screw thread 17 of the container 12 is also for cooperating with a female screw thread (not shown) of the closure cap 14 to detachably secure the closure cap 14 to the container 12. A user may detach/attach the closure cap 14 from/to the container 12 by rotating the closure cap 14 relative to the container 12 to disengage/engage the cooperating respective screw threads 17 of the closure cap 14 and the container 12.

Assembly of the deodorant dispenser 1 shown in FIGS. 4 to 6 will now be described. First, the closure cap 14 is detached from the container 12 by rotating the closure cap 14 relative to the container 12 to disengage the cooperating respective screw threads 17 of the closure cap 14 and the container 12. Once the closure cap 14 has been removed, the chamber 16 and the fluid deodorant composition therein is fluidly connected with the exterior of the container 12. Next, the container 12 is detachably secured to the body 22 of the applicator assembly 20 by rotating the container 12 relative to the body 22 while mating the male screw thread 17 of the container 12 with the female screw thread (not shown) of the body 22. During this step, a first portion, comprising a first end 18, of the refill cartridge 10 is received through the aperture 28 into the cavity 29 of the body 22 and the chamber 16 of the refill cartridge 10 is brought into fluid communication with the applicator 24. Thereafter, the cap 40 is detachably secured to the body 22 by rotating the cap 40 relative to the body 22 while mating the pins of the cap 40 with the receptors 23 of the body 22. The dispenser 1 is thus fully assembled.

When a user wishes to use the dispenser 1 to apply the fluid deodorant composition to their skin, the user detaches the cap 40 from the body 22 by rotating the cap 40 relative to the body 22 to disconnect the pins of the cap 40 from the receptors 23 of the body 22. While holding the container 12 at a height greater than the applicator 24, the user presses the applicator 24 to their skin and applies a force to the container 12 to cause relative movement of the applicator 24 and the body 22. By holding the container 12 higher than the applicator 24, under the influence of gravity the fluid deodorant composition in the chamber 16 tends towards the applicator 24. The relative movement of the applicator 24 and the body 22 causes the applicator 24 to transport the fluid deodorant composition from the chamber 16 to an exterior of the dispenser 1, i.e. to the portion of the applicator 24 that is exposed at the exterior of the dispenser 1, and thus causes the fluid deodorant composition to be deposited as a thin film on the user's skin.

When most or all of the fluid deodorant composition in the chamber 16 has been dispensed, the refill cartridge 10 can be replaced. To do this, the user detaches the container 10 from the body 22 by rotating the container 10 relative to the body 22 to disconnect the male screw thread 17 of the container 10 from the female screw thread of the body 22. The user then disposes of the refill cartridge 10. Preferably the refill cartridge 10 is made of a recyclable material, and the user sends the refill cartridge 10 for recycling. The user then re-assembles the dispenser 1 in the manner discussed above, but using a new, full refill cartridge 10. Accordingly, since the refill cartridge 10 may be disposed of without disposing of the whole dispenser 1 (i.e. without also dispensing of the applicator assembly 20 and cap 40), much of the dispenser 1 is re-usable, which is a more efficient use of the materials from which the dispenser 1 is made.

Prior to full assembly of the dispenser 1, the apparatus shown in FIG. 4 can be considered a kit comprising (a) the deodorant dispenser refill cartridge 10 including the container 12 and closure cap 14, and (b) the rest of the components of the dispenser 1. In some cases, the dispenser 1 may be supplied without any deodorant dispenser refill cartridge 10, so that the deodorant dispenser refill cartridge 10 is supplied separately from the rest of the dispenser 1. Indeed, a plurality of deodorant dispenser refill cartridges 10, each with a respective closure cap 14, may be bundled or packaged together for purchase by a user, in order for the user to be able to use each of the plurality of deodorant dispenser refill cartridges 10 in turn with the rest of the dispenser 1.

In a variation to the second embodiment, the seal 14 of the refill cartridge 10 may comprise a puncturable film, membrane or foil that is adhered or welded to the rim at the first end 18 of the container 12. The closure cap may be omitted. In such a variation to the second embodiment, the device 26 of the applicator assembly 20 may be provided, so as to puncture the seal 14 when the container 12 is detachably secured to the body 22 and the first portion, comprising the first end 18, of the refill cartridge 10 is received through the aperture 28 into the cavity 29 of the body 22, similarly to as described above for the first embodiment.

While the device 26 discussed above is within the cavity 29 and extends along at least a portion of an edge region of the cavity 29, in variations to the described embodiments the device 26 may take a different form. For example, the device may take the form of a sharpened dip tube within the cavity 29 and extending through the aperture 28, in or away from the edge region of the cavity 29. The device may be closer to the centre of the cavity 29 than to the material of the body 22 that defines the cavity 29. Alternatively, the device may be a sharp point that extends from within the cavity 29 through the aperture 28. In some variations to the described embodiments, a plurality of devices 26 may be provided, each device being of any one of the types of device discussed above. For example, a plurality of sharpened dip tubes or a plurality of sharp points may be provided, or one or more sharpened dip tubes and a plurality of sharp points may be provided.

While the applicator 24 discussed above is movable relative to the body for transporting the fluid deodorant composition to the exterior of the dispenser, in variations to the described embodiments the applicator may take a different form. For example, the applicator may not be movable relative to the body. The applicator may comprise a surface, such as a flat surface or a convex surface (e.g. a domed surface), having one or more holes via which the fluid deodorant composition is flowable to the exterior of the dispenser. Alternatively, the applicator may comprise any one or more of: a dauber, bristles, a porous material, a foam material, a sponge material, a woven material, and a fibrillated material.

What is claimed is:

1. A kit, comprising:

a deodorant dispenser refill cartridge, comprising:

a refill cartridge container defining a chamber storing a fluid deodorant composition and having a rim defining an opening through which the composition is dispensable from the chamber, the refill cartridge container extending from a first end having the rim to a second closed end, the refill cartridge container comprising a radially-outwardly extending annular flange at the first end, said flange surrounding said rim of said opening, said flange being configured to mate with a corresponding feature on a deodorant dispenser into which the refill cartridge is inserted; and a seal sealing the opening, wherein the fluid deodorant composition is a fluid antiperspirant composition, wherein the seal comprises a closure cap detachably secured to the container; and a deodorant dispenser comprising a body connectable to the refill cartridge, and an applicator for applying the fluid deodorant composition to a user at an exterior of the dispenser.

2. The kit of claim 1, wherein the container has a circular cross section.

3. The kit of claim 1, wherein the applicator is movable relative to the body for transporting the fluid deodorant composition to the exterior of the dispenser.

4. The kit of claim 1, wherein the deodorant dispenser comprises a device for puncturing the seal of the refill cartridge as the refill cartridge is connected to the body.

5. The kit of claim 4, wherein the body has a cavity for receiving a first portion of the refill cartridge, wherein the device is within the cavity and extends along at least a portion of an edge region of the cavity, and wherein the device is for puncturing the seal of the refill cartridge as the first portion of the refill cartridge is received into the cavity.

6. The kit of claim 4, wherein the device extends into the opening and along at least a portion of an edge area of the chamber when the refill cartridge is connected to the body.

7. The kit of claim 1, wherein the applicator is rotatable about a fixed axis relative to the body, or wherein the applicator is freely rotatable relative to the body without constraint to rotation about a fixed axis.

8. The kit of claim 1, comprising a handle detachably securable to the body, wherein at least a portion of the refill cartridge is disposed within the handle when the refill cartridge is connected to the body and the handle is detachably secured to the body.

9. The kit of claim 1, wherein, when the refill cartridge is connected to the body, the refill cartridge forms a portion of an exterior surface of the deodorant dispenser.

10. A deodorant dispenser, comprising:

a body connected to a removable refill cartridge, the refill cartridge comprising a container defining a chamber storing a fluid deodorant composition and having an opening through which the composition is dispensable from the chamber, the container comprising a radially-outwardly extending annular flange surrounding said opening, said flange being configured to mate with a rim of the body into which the container is inserted; and an applicator for applying the fluid deodorant composition to a user at an exterior of the dispenser, wherein the body has a device that extends into the opening and along at least a portion of an edge area of the chamber of the refill cartridge, and wherein the refill cartridge forms a portion of an exterior surface of the deodorant dispenser.

11. The deodorant dispenser of claim 10, wherein the applicator is movable relative to the body for transporting the fluid deodorant composition to the exterior of the dispenser.

12. The deodorant dispenser of claim 10, wherein the body has a cavity in which a portion of the refill cartridge is received, wherein the device is disposed within the cavity and extends along at least a portion of an edge region of the cavity.

13. The deodorant dispenser of claim 10, wherein the refill cartridge is detachably secured to the body by cooperating respective screw threads of the refill cartridge and the body.

14. The deodorant dispenser of claim 10, comprising a handle detachably secured to the body and forming a portion of an exterior surface of the deodorant dispenser, wherein at least a portion of the refill cartridge is disposed within the handle.

15. The deodorant dispenser of claim 10, wherein the applicator is rotatable about a fixed axis relative to the body, or wherein the applicator is freely rotatable relative to the body without constraint to rotation about a fixed axis.

16. The deodorant dispenser of claim 10, further comprising a securing device removably connecting the body to the refill cartridge, wherein the securing device consists of cooperating respective female screw threads and male screw threads, wherein the female screw threads are provided on the body.

17. A deodorant dispenser, comprising:

a body having a cavity for receiving a first portion of a removable refill cartridge, the refill cartridge comprising:

a refill cartridge container defining a chamber storing a fluid deodorant composition and having a rim defining an opening through which the composition is dispensable from the chamber, the refill cartridge container extending from a first end having the rim to a second closed end, the refill cartridge container comprising a radially-outwardly extending annular flange at the first end, said flange surrounding said rim of said opening, said flange being configured to mate with a corresponding feature on a deodorant dispenser into which the refill cartridge is inserted; and a seal sealing the opening, wherein the fluid deodorant composition is a fluid antiperspirant composition, wherein the seal comprises a closure cap detachably secured to the container;

a device within the cavity and extending along at least a portion of an edge region of the cavity for puncturing the seal of the refill cartridge as the first portion of the refill cartridge is received in the cavity of the body; and an applicator for applying the fluid deodorant composition to a user at an exterior of the dispenser, wherein the applicator is movable relative to the body for transporting the fluid deodorant composition to the exterior of the dispenser.

18. The deodorant dispenser of claim 17, wherein the device is tapered.

19. The deodorant dispenser of claim 17, wherein the device is a discontinuous device that extends along only a portion of the edge region of the cavity.

20. The deodorant dispenser of claim 17, wherein the body comprises a securing device for securing the refill cartridge to the body.

21. The deodorant dispenser of claim 17, comprising a handle detachably securable to the body to form a portion of an exterior surface of the deodorant dispenser, wherein at least a second portion of the refill cartridge is disposed within the handle when the first portion of the refill cartridge is received in the cavity and the handle is detachably secured to the body.

22. The deodorant dispenser of claim 17, wherein the applicator is rotatable about a fixed axis relative to the body, or wherein the applicator is freely rotatable relative to the body without constraint to rotation about a fixed axis.

* * * * *